United States Patent [19]

David

[11] 4,056,260

[45] Nov. 1, 1977

[54] ENVIRONMENTAL PLATELET AGITATOR

[76] Inventor: Melvin J. David, 16221 Quemada Road, Encino, Calif. 91314

[21] Appl. No.: 729,372

[22] Filed: Oct. 4, 1976

[51] Int. Cl.[2] ..... B01F 9/04

[52] U.S. Cl. ..... 366/144; 134/159; 134/112; 211/41; 366/235

[58] Field of Search ..... 259/57, 81 R, 81 A, 259/89, 90; 134/112, 140, 159; 211/41; 51/164

[56] References Cited

U.S. PATENT DOCUMENTS

| | | | |
|---|---|---|---|
| 951,978 | 3/1910 | Willson | 259/54 |
| 3,422,959 | 1/1969 | Sharaf | 211/41 R |
| 3,682,080 | 8/1972 | Merz | 354/327 |
| 3,711,379 | 1/1973 | Adams | 259/57 |

*Primary Examiner*—Harvey C. Hornsby
*Assistant Examiner*—Timothy Simone
*Attorney, Agent, or Firm*—Michael A. Painter

[57] ABSTRACT

Apparatus for maintaining the freshness of blood platelet concentrate and related solutions which require continuous agitation to maintain usuable shelf life. A container for holding platelet concentrate packets contains a series of parallel cells which are disposed at an oblique angle with respect to a horizontal plane. A plurality of platelet packet containers are disposed within an equal number of cylinders which are adapted to securely hold the containers. Each cylinder has circumscribed about the outer surface thereof a friction transfer surface, each of which is aligned to contact the friction transfer bearing surface of an adjacent cylinder. A rotating power source engages a friction transfer surface of a cylinder causing same to rotate, the rotational force being transferred to all adjacent cylinders. Environmental control means maintain an appropriate temperature state during the agitation of all platelet packets being operated upon.

10 Claims, 5 Drawing Figures

Fig. 1.
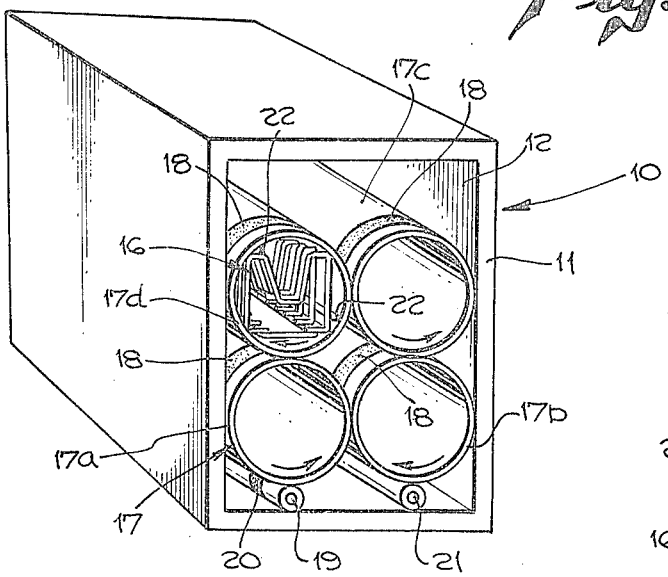
Fig. 3.
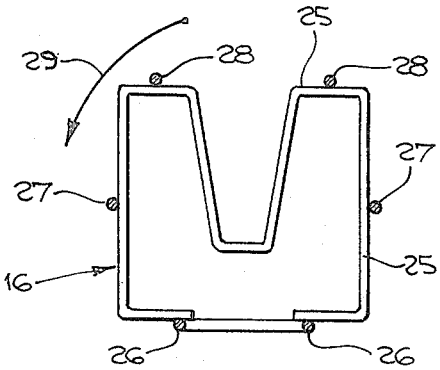
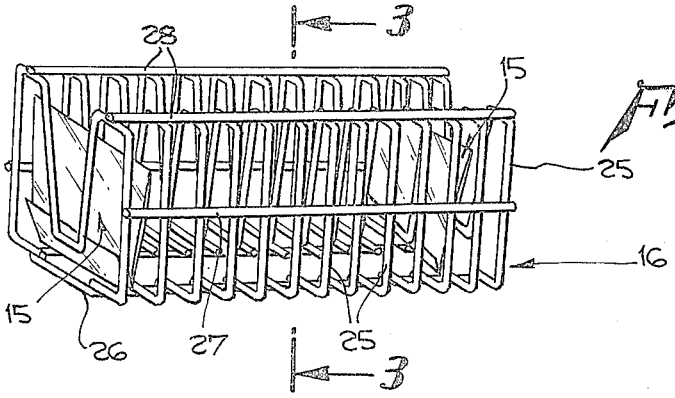
Fig. 2.
Fig. 5.
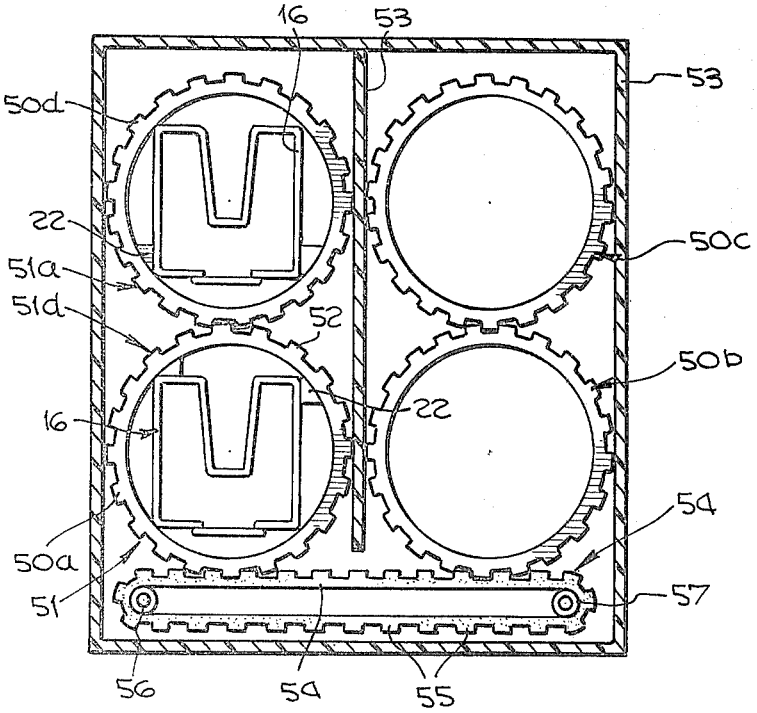
Fig. 4.
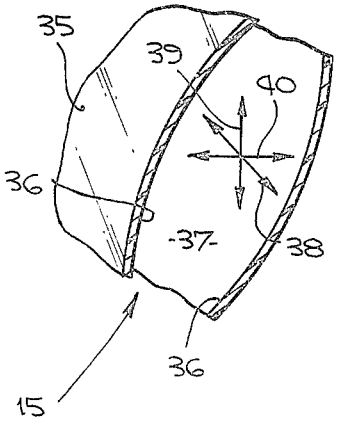

ENVIRONMENTAL PLATELET AGITATOR

BACKGROUND OF THE INVENTION

1. Field of the Invention

The present invention generally relates to environmental apparatus for chemical solutions and, more particularly, to those apparatus adapted to maintain solutions in a constantly agitated state.

2. Prior Art

The present invention is specifically adapted to maintain the effectiveness of chemical solutions which require a predetermined environmental state while maintaining the solution in a constant state of agitation. In particular, the present invention is adapted for use with blood platelet concentrate which must be maintained under precise environmental conditions in order to preserve its effectiveness. As an example, blood platelet concentrate used for blood transfusions specifically require that it be stored at a temperature of between 20°-24° C and that the concentrate be maintained under constant agitation. The basis for these requirements arises out of the nature of the platelet concentrate. The constituant elements must be maintained in a state of agitation in order to prevent any solid elements of the concentrate from congealing or adhering to the walls of the container. At the present time, the devices and procedures disclosed by the prior art limit the shelf life of platelet concentrate to approximately seven days.

The devices and procedures utilized to preserve solutions such as blood platelet concentrate are crude and are not adapted to the specific problems inherent to such solutions. As an example, many hospitals or other depositories of platelet concentrate use periodic agitation by technicians as an attempt to comply with the environmental requirements which are necessary to maintain the effectiveness of the solution. A number of conventional agitation units are also utilized for solutions such as platelet concentrate, but these have inherent inadequacies which clearly limit the shelf life of the valuable comodity.

A mechanical device which is typically used for agitation of blood platelet concentrate provides for periodic vertical agitation of the platelet packets. This element alone creates a basic problem with this type of device. Platelet concentrate is typically stored in substantially flat vinyl packets. Since platelet concentrate will tend to adhere to the interior surface of the packaging unless constant agitation is maintained, vertical movement of the packets alone will not maintain sufficient agitation to fully prevent the blood platelet concentrate from congealing or otherwise spoiling.

The present invention substantially resolves a great number of problems which are inherent to the procedures and devices which are currently utilized. Blood platelet packets are maintained in a container which utilizes a series of parallel cells which are maintained at an oblique angle with respect to a horizontal plane. Each container is insertable within a rotatable cylinder which will rotate the packets about an axis which is parallel to a horizontal plane. Since the packets are maintained at an oblique angle with respect to a horizontal plane, the constant rotation of the packets will create a movement profile of the platelet concentrate in a three dimensional configuration. In addition, the ease of maintaining constant agitation at a temperature which is critical to the state of the concentrate produces a device which substantially exceeds all procedures and apparatus which are disclosed by the prior art.

SUMMARY OF THE INVENTION

The present invention comprises an environmental blood platelet agitator which is used to maintain accurate environmental conditions for solutions which are typically represented by blood platelet concentrate. Blood platelet concentrate is a viscous solution which contains blood platelets prepared from human whole blood. Characteristics of blood platelet concentrate necessitate that it be maintained within a precise temperature range and be stored under constant agitated conditions. In the absence of the above environmental conditions, elements of the concentrate will congeal, adhere to the inner surface of the storage media, become contaminated or otherwise spoiled due to improper temperatures. Although the present invention is described in connection with blood platelet concentrate, it is clear that the present invention can be used to maintain the effectiveness of any liquid solution which requires accurate environmental control and continuous agitation. For the purpose of example only, the remainder of this disclosure shall assume use of the present invention in connection with the maintenance of human blood platelet concentrate.

A platelet packet container comprises a series of identical cells which are in parallel spaced relation to each other. The cells are disposed at an oblique angle with respect to the longitudinal axis of the container which, when in use, will lie in a horizontal plane. Each of the plurality of containers is disposed within a cylindrical shell which includes means for preventing the containers from moving relative to the inner surface of the shell. A frictional transfer surface is disposed about the circumference of each of the cylindrical shells, the frictional transfer surfaces of each shell being adapted to be aligned with each other. The cylindrical shells are amounted in alignment with each other whereby the frictional transfer surface of one shell is in contact with the frictional transfer surface of all adjacent shells. A rotational power source is mounted adjacent the frictional transfer surface of at least one cylindrical shell and rotated at a speed which will rotate the cylindrical shells at an angular velocity of one to two revolutions per minute. The rotational source imposed by the power source will be transmitted to all cylindrical shells providing identical rotational speeds to all of the cylindrical shells and the platelet containers disposed therein.

The rotational motion induced by the rotational power source and transferred to the shells will cause the blood platelet concentrate to be agitated in a three dimensional configuration to preclude any elements within the concentrate from congealing or otherwise adhering to the interior surface of the platelet concentrate package.

It is therefore an object of the present invention to provide an improved environmental agitator for liquid solutions.

It is another object of the present invention to provide a blood platelet concentrate agitator which maintains three dimensional agitation.

It is still another object of the present invention to provide a liquid solution agitator which is modular.

It is still yet another object of the present invention to provide a liquid solution agitator which is simple and inexpensive to fabricate.

The novel features which are believed to be characteristic of the invention, both as to its organization and method of operation, together with further objectives and advantages thereof will be better understood from the following description considered in connection with the accompanying drawing in which a presently preferred embodiment of the invention is illustrated by way of example. It is to be expressly understood, however, that the drawing is for the purpose of illustration and description only and is not intended as a definition of the limits of the invention.

BRIEF DESCRIPTION OF THE DRAWING

FIG. 1 is a perspective view of a portion of an environmental agitator constructed in accordance with the present invention.

FIG. 2 is a perspective view of the platelet package container shown mounted in FIG. 1.

FIG. 3 is a cross-sectional view of the platelet packet container taken through line 3—3 of FIG. 2.

FIG. 4 is a schematic view of the interior of a platelet packet illustrating the three dimensional agitation when subjected to the operation of the present invention.

FIG. 5 is a side elevation, schematic view of another form of the present invention.

DESCRIPTION OF THE PRESENTLY PREFERRED EMBODIMENT

An understanding of the present invention can be best gained by reference to FIG. 1 wherein a perspective view of a typical environmental enclosure is shown incorporating the present invention, the enclosure being generally designated by the reference numeral 10. Enclosure 10 incorporates insulated walls 11 which will permit the interior compartment 12 to be appropriately cooled. As stated hereinabove, blood platelet concentrate must be maintained at a temperature of between 20° and 24° C to prevent the concentrate from becoming contaminated. The insulation used to implement walls 11 of enclosure 10 can comprise any conventional material currently in use for the construction of refrigeration or heat retention systems and does not constitute a portion of the present invention. Enclosure 10 is cooled by a conventional cooling unit (not shown). An object of the present invention is to provide for protability of the present invention system so that same can be used at remote sites. In order to implement this objective, the cooling unit can be one of a number of commercially available units which operate on both direct and alternating current sources. As an example, direct current power units are available from the A & E Plastic Pack Co. and will operate at 12 VDC. Although the preferred embodiment of the present invention is utilized as a cooled environment, it is within the scope of the present invention to employ heating units to raise the temperature of enclosure 10.

Platelet concentrate packets 15 are stored in containers 16. As shown in FIG. 1, the containers 16 used to hold the platelet concentrate packets 15 are inserted into receiving cylinders 17 for the purpose of being subjected to the necessary agitation. Each cylinder 17 has a frictional transfer surface 18 disposed about the outer circumference thereof, the frictional transfer surface disposed about each cylinder 17 being aligned to contact the respective frictional transfer surface 18 on adjacent cylinders 17. Cylinders 17 are aligned vertically and horizontally to insure that the frictional transfer surface 18 is in contact with at least one of the cylinders 17 which is in direct communication with aligned, frictional transfer surface 20 disposed about rotating power source 19. Rotating power source 19 can be any one of a number of conventional rotating units such as a properly geared DC motor which can provide cylinders 17 angular rotation at a speed of approximately one or two revolutions per minute. As can be seen from FIG. 1, the embodiment of the present invention shown therein utilizes a rotating power source 19 which incorporates a frictional transfer surface which is aligned with the frictional transfer surface 18 mounted about cylinder **17*a*. In order to permit the single rotating power source 19 to provide the necessary movement to cylinder 17, bearing surface 21 permits cylinder 17*b* to freely rotate as a result of frictional engagement with the frictional transfer surface 18 of cylinder 17*a*. Bearing surface 21 can be implemented through the use of conventional roller bearings or other like devices. Bearing surface 21 maintains cylinder 17*b* in substantially the same plane as cylinder 17*a* to insure that the alignment of all cylinders 17** is suitable.

As set forth hereinabove, platelet packet containers 16 are removeably stored within the interior cavity of receiving cylinders 17. Wedges 22 are mounted along the longitudinal surface of the interior cavity of receiving cylinders 17 to prevent container 16 from moving relative to the respective cylinder 17. Platelet packet container 16 can be best seen by reference to FIG. 2 and FIG. 3. Each of the platelet packet containers 16 comprises a plurality of cells, each of which is adapted to hold a platelet packet 15 such as is shown in FIG. 2. The form of the platelet packet container 16 is constructed of a series of separators 25 which are joined together in parallel spaced relation through the use of bottom supports 26, side supports 27 and top supports 28. As can be seen in FIG. 2, top supports 28 are pivotal about the portion of an end separator 25 in a manner which opens or closes access to the cells intermediate each pair of adjacent separators 25. Each platelet cell is formed by an adjacent pair of separators 25. When platelet packet container 16 is implemented in the manner described hereinabove, standard metal tubular members can be used. It is, of course, within the scope of the present invention to fabricate platelet packet containers 16 from other conventional materials such as rigid plastic.

As stated hereinabove, the devices and procedures utilized and disclosed in the prior art do not generally provide a shelf life for blood platelet concentrate which exceeds a period of seven days. One of the problems which causes this reduced shelf life is the inability to properly agitate the platelet packets to insure that the platelet concentrate will not congeal or otherwise adhere to the inner walls of the packet. As shown in FIG. 2, each of the cells formed by adjacent separators 25 is disposed at an oblique angle with respect to a horizontal plane. In the case of that shown in FIG. 2, the horizontal plate is typically represented by the direction of side supports 27. In operation, a stored blood platelet packet 15 will be rotated such as represented by the directional arrow 29.

Referring now to FIG. 4, a blood platelet packet is generally constructed from inert material such as polyvinyl chloride which will form enclosing walls 35, the inner surfaces 36 being in direct contact with the viscous concentrate solution 37. As discussed, platelet concentrate is a viscous solution which is derived from whole blood. Unless the concentrate is maintained in a constant state of agitation, it will not only tend to congeal, but it will tend to adhere to walls 36. When platelet packet container 16 is rotated in a manner schematically designated by rotational arrow 29, concentrate 37 will tend to be agitated in a three dimensional configuration (FIG. 4). Although over-simplified, the rotation 29 will cause movement of platelet elements in the direction designated by the reference numerals 38 and 39. By forming the cells intermediate separators 25 at an oblique angle with respect to the horizontal plane, the elements of the platelet concentrate will adopt a movement vector which is substantially parallel to a horizontal plane as pictorially designated by the reference numeral 40. The vectorial movement of the platelet concentrate as designated by the reference numerals 38, 39 and 40 will cause complete agitation of the platelet concentrate in a manner which will cause a constant washing of interior walls 36 and thereby prevent the concentrate from congealing or otherwise adhering to the surface of inner walls 36.

Another form of the present invention can be best seen by reference to FIG. 5. The form of the present invention shown in FIG. 1 utilizes a frictional transfer surface 18 which can be typically implemented through the use of a strip of rubber. To permit a substantial number of receiving cylinders to be vertically stacked upon one another, a form of the present invention such as that shown in FIG. 5 can be utilized. Receiving cylinders 50*a*–50*d* can be stacked both horizontally and vertically to meet the needs of the particular application. To provide for increased power a geared belt 51 is disposed about the outer circumference of each cylinder 50. The vertical stacking of cylinders is accomodated by interleaving the teeth 52 of the adjacent geared belt 51 so that any force imposed on geared belt 51*a* disposed about cylinder 50*a* would be necessarily transmitted to a belt 51*d* disposed about cylinder 50*d*. As stated, an objective of the present invention is to provide for simplified stacking of the cylinders in both a vertical and horizontal direction. In the form of the present invention shown in FIG. 5, each vertical column of cylinders 50 is separated by a divider 53 which is typically fabricated of a non-frictional material which will permit the cylinders 50 and the belts 51 disposed thereabout to rotate without creating excessive frictional forces. By providing a divider 53, an unlimited number of vertical columns can be utilized and the height of the vertical column can be adapted to the particular application involved. The power source used in the form of the present invention shown in FIG. 5 would constitute and endless belt 54 which is comprised of interleaved gear teeth 55 which are adapted to mate with the teeth 52 of gear belts 51*a* and 51*b* which are disposed about cylinders 50*a* and 50*b* respectively. The horizontal length of endless belt 54 is dependent only upon the number of vertical columns which are used to fabricate the form of the present invention shown in FIG. 5. Although FIG. 5 shows only two vertical columns, it is understood that the number of columns can be selected to suit the application.

Endless belt 54 is mounted upon rollers 56 and 57 which are coupled to a source of rotary power (not shown). The rotary power supplied to rollers 56 and 57 is similar to that described in connection with rotary power source 19 in that the motion of endless belt 54 will cause cylinders 50 to rotate at a speed of approximately 1–2 revolutions per minute.

Platelet packet containers 16 are disposed within cylinders 50 in the same manner as that described in connection with FIG. 1. In addition, the construction of platelet packet containers 16 is identical with that described in connection with FIG. 2 and FIG. 3. With respect to the form of the present invention shown in FIG. 5, wedges 22 are disposed longitudinally along the inner surfaces of cylinder 50*a*–50*d* to prevent any relative motion between containers 16 and cylinders 50 in the same manner as was described in connection with FIG. 1.

The present invention comprises an improved environmental agitator which is specifically adapted for use with solutions such as blood platelet concentrate. A series of platelet package containers are oriented to provide for three dimensional agitation of the platelet concentrate, the containers being mounted within an environmental enclosure which is modular and therefor adaptable to the specific application.

I claim:

1. An environmental solution agitator for use with solution packets comprising:

a. an insulated enclosure having an interior compartment;

b. cylindrical members having a cylindrical inner cavity and a cylindrical outer surface disposed within the interior compartment of said enclosure, the longitudinal axis of each of said cylindrical members being in a horizontal plane;

c. frictional transfer means for transferring rotational force secured about the outer surface of each of said cylindrical members, each of said cylindrical members being in parallel alignment within said enclosure in abutment with adjacent cylindrical members, said frictional transfer means secured about adjacent cylindrical members being in frictional contact with each other;

d. solution packet containers comprising a plurality of separator elements, each of said separator elements being coupled in parallel spaced relation to each other, each pair of adjacent separator elements defining cells therebetween for receiving the solution packets, said solution packet container having a longitudinal axis along said coupled separator elements, each of said separator elements being disposed at a uniform oblique angle with respect to the longitudinal axis of said container, said solution packet container being disposed within the interior cavity of respective ones of said cylindrical members whereby the longitudinal axis of said cylindrical member and said solution packet containers are parallel to each other; and e. rotating power means for providing a source of rotary power disposed within the interior compartment of said enclosure and being coupled to said frictional transfer means.

2. An environmental solution agitator as defined in claim 1 wherein said cylindrical members are vertically and horizontally stacked within the interior compartment of said enclosure, the frictional transfer means secured about the outer surface of each of said cylindrical members being adapted to contact the frictional contact means of the cylindrical members vertically and horizontally adjacent said frictional transfer means.

3. An environmental solution agitator as defined in claim 2 wherein said frictional transfer means comprises an endless pliable rubber belt disposed about the circumference of the outer surface of each cylindrical member, each rubber belt contacting the outer surface of horizontally and vertically adjacent belts whereby said rotating power means causes said cylindrical member to rotate.

4. An environmental solution agitator as defined in claim 3 wherein said rotary power means comprises angular rotation of said cylindrical members in the range of one to two revolutions per minute.

5. An environmental solution agitator as defined in claim 1 wherein said cylindrical members are vertically and horizontally stacked within the interior compartment of said enclosure, said frictional transfer means comprising a geared surface secured about the outer surface of each of said cylindrical members, each geared surface having uniformly spaced gear teeth disposed thereabout the grooved teeth of adjacent vertically stacked cylindrical members being engaged at the interface therebetween, and further including non-frictional surface means for separating vertical stacks of cylindrical members, said non-frictional surface means being disposed between each adjacent stack of cylindrical members.

6. An environmental solution agitator as defined in claim 5 wherein said rotary power means comprises a powered rotary member, idler means for rotating synchroniously with respect to said power rotating member and an endless geared belt disposed about said rotating member and said idler means, said powered rotating member and said idler means being horizontally spaced between the outer, vertical stack of cylindrical members, said geared belt being meshed with the geared teeth of the geared belt secured about each of the lowest cylindrical member in each vertical stack.

7. An environmental solution agitator as defined in claim 1 wherein each of said separator elements comprises a planar tubular frame substantially the same shape as the solution packets, each of said spaced tubular frames being fixedly coupled to one another leaving an opening to each cell sufficient for insertion of a solution packet and cover means for closing the opening to each cell coupled to the terminus of said solution packet container.

8. An environmental solution agitator as defined in claim 7 further including a plurality of wedging means for inhibiting movement longitudinally secured along the surface of the inner cavity of each of said cylindrical member, said wedging means being adapted to engage the tubular frame of said separator elements whereby relative movement between said solution packet containers and said cylindrical members is inhibited.

9. An environmental solution agitator as defined in claim 1 further including cooling means for maintaining the interior compartment within a predetermined temperature range.

10. An environmental platelet solution agitator for use with platelet solution packets comprising:

a. an insulated enclosure having an interior compartment;

b. cooling means for maintaining the interior compartment of said enclosure at a predetermined temperature coupled to said enclosure;

c. cylindrical members having a cylindrical inner cavity and an outer cylindrical surface being disposed within the interior compartment of said housing, the longitudinal axis of said cylindrical member being in a horizontal plane;

d. frictional transfer belts secured about the outer surface of each of said cylindrical members, each of said cylindrical members being aligned within said enclosure in abuttment with adjacent cylindrical members, the frictional transfer belt secured about adjacent cylindrical members being in frictional contact with one another;

e. rotating power means for providing a source of rotary power disposed within the interior compartment of said enclosure and being coupled to said frictional transfer means;

f. platelet packet containers comprising a plurality of separator elements, each of said separator elements being substantially the same shape as said platelet packet, each of said separator elements being coupled in parallel spaced relation to each other, each pair of adjacent separator elements defining a cell therebetween for receiving a platelet packet, said coupling of said separator elements leaving an opening to each cell sufficient for insertion of a platelet packet, and further including cover means for closing the opening to the cell coupled to a terminating separator element of said container, each of said separator elements being disposed at a uniform oblique angle with respect to an axis directed along said coupled separator element, said platelet packet container being securely disposed within the interior cavity of respective ones of said cylindrical members; and g. rotary power means for providing a source of rotary power disposed within the interior compartment of said interior enclosure and being coupled to said frictional transfer belts whereby said cylindrical members and said platelet packet containers are rotated at an angular velocity synchronious to said rotary power means.

* * * * *